US006912288B2

(12) United States Patent
Nakashima et al.

(10) Patent No.: US 6,912,288 B2
(45) Date of Patent: Jun. 28, 2005

(54) PIEZOELECTRIC ELECTROACOUSTIC TRANSDUCER AND MANUFACTURING METHOD OF THE SAME

(75) Inventors: Mikio Nakashima, Toyama-ken (JP); Sachihito Nakafuku, Toyama (JP); Kiyoshi Iyama, Himi (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 117 days.

(21) Appl. No.: 10/173,032

(22) Filed: Jun. 18, 2002

(65) Prior Publication Data

US 2003/0007651 A1 Jan. 9, 2003

(30) Foreign Application Priority Data

Jul. 3, 2001 (JP) ..... 2001-202541

(51) Int. Cl.[7] ..... H04R 25/00

(52) U.S. Cl. ..... 381/190; 381/398; 381/114; 381/173; 310/324; 310/345; 310/332; 181/170; 181/171

(58) Field of Search ..... 381/114, 173, 381/190, 398, 426; 181/164, 167, 170, 174; 310/344, 324, 382, 345, 348, 359

(56) References Cited

U.S. PATENT DOCUMENTS 5,684,884 A * 11/1997 Nakaya et al. ..... 381/190
5,889,873 A * 3/1999 Sasaki ..... 381/190
5,991,988 A * 11/1999 Tabota et al. ..... 29/25.35
6,040,652 A * 3/2000 Kaida ..... 310/320
6,424,080 B2 * 7/2002 Ando et al. ..... 310/358
6,437,488 B1 * 8/2002 Sube et al. ..... 310/366
6,577,486 B1 * 6/2003 Nishimiya et al. ..... 361/104

FOREIGN PATENT DOCUMENTS

JP 10-336792 12/1998
JP 2001-95094 4/2001

* cited by examiner

*Primary Examiner*—Curtis Kuntz
*Assistant Examiner*—Dionne Harvey
(74) *Attorney, Agent, or Firm*—Keating & Bennett, LLP

(57) ABSTRACT

A piezoelectric electroacoustic transducer, including a plurality of piezoelectric layers deposited to define a deposited product, flexurally vibrates the deposited product by polarizing the entire piezoelectric ceramic layers in the same thickness direction and also by applying an alternating signal between external electrodes disposed on the front/rear major surfaces of the deposited product and an internal electrode disposed between the ceramic layers. A dummy electrode is provided between the ceramic layers outside the internal electrode via a gap, and a portion of the internal electrode is exposed at at least one side surface of the piezoelectric ceramic layers, while the dummy electrode is exposed at the other side surface of the piezoelectric ceramic layers. The external electrodes extend to the side surfaces other than the side surface at which the internal electrode is exposed.

12 Claims, 11 Drawing Sheets

PIEZOELECTRIC ELECTROACOUSTIC TRANSDUCER AND MANUFACTURING METHOD OF THE SAME

BACKGROUND OF THE INVENTION

1. Field of the Invention

The present invention relates to a piezoelectric electroacoustic transducer such as a piezoelectric receiver, piezoelectric sounder, piezoelectric speaker, and piezoelectric buzzer, and a manufacturing method thereof.

2. Description of the Related Art

In conventional electronic devices, home electronic appliances, portable telephones, and other such apparatuses, piezoelectric electroacoustic transducers have been widely used as a piezoelectric buzzer or piezoelectric receiver for providing an alarm sound or operating sound. A configuration of such a piezoelectric electroacoustic transducer generally is that a piezoelectric element is bonded on one surface of a metallic plate to define a unimorph-type diaphragm, the periphery of the metallic plate is supported in a case, and an opening of the case is closed with a cover.

However, the unimorph-type diaphragm has a drawback in that the displacement, i.e., sound pressure is small because a ceramic plate, which expands and contracts in the external diameter by voltage application, is bonded on a rigid metallic plate so as to flexually vibrate.

Then, a bimorph-type diaphragm having a deposited structure including a plurality of piezoelectric ceramic layers is disclosed in Japanese Unexamined Patent Application Publication No. 2001-95094. This diaphragm is configured such that two or three piezoelectric ceramic layers are deposited to form a deposited product having external electrodes disposed on the front/rear surfaces of the product and internal electrodes disposed between respective layers. All the ceramic layers are polarized in the same thickness direction, and by applying an alternating signal to between the external and internal electrodes, the deposited product is flexurally vibrated.

Such a diaphragm of the deposited structure has an advantage that a larger displacement, i.e., larger sound pressure, can be obtained in comparison with a unimorph-type diaphragm.

When manufacturing the diaphragm of the deposited structure described above, there is a problem in that the risk of a short circuit may be created between the internal electrode exposed on an end surface of the deposited product and the external electrode because of migration due to the very small thickness of each ceramic layer.

As an anti-migration measure, as shown in FIG. 1, there may be an electrode-forming method in which front/rear external electrodes 2 and 3 are exposed to at least one side of a ceramic layer 1 and trimmed parts 2*a* and 3*a*, from which the external electrodes 2 and 3 are cut out, are disposed on the other sides, while a trimmed part 4*a* of an internal electrode 4 is disposed on one side, at which the external electrodes 2 and 3 are exposed, and the internal electrode 4 is exposed at the remaining sides. In addition, the rear external electrode 3 is depicted as a projected figure in FIG. 1. From such an electrode configuration, on each side surface of the ceramic layer 1, the external electrodes 2 and 3 cannot come close to the internal electrode 4 in the thickness direction, thereby eliminating the migration.

In addition, referring to FIG. 1, on the respective three sides of the external electrodes 2 and 3, the trimmed parts 2*a* and 3*a* are formed while the trimmed part 4*a* is formed on the one side of the internal electrode 4. Conversely, even when forming the trimmed part on the three sides of the internal electrode 4 and the respective trimmed parts on the one side of the external electrodes 2 and 3, the same advantage can be obtained.

However, when polarization is performed on a deposited product having such an electrode configuration by applying a DC voltage, there is a problem that cracks in the ceramic layer 1 may be produced in the boundary between the internal electrode 4 and the trimmed part 4*a* because of the expansion difference of the ceramic layer 1 in between the internal electrode 4 and the trimmed part 4*a*, reducing the yield ratio. That is, the side of the ceramic layer 1 having the internal electrode 4 exposed on the side surface is prevented from expanding by the internal electrode 4, whereas the side of the ceramic layer 1 having the trimmed part 4*a* expands largely, so that the cracks are produced in the ceramic layer 1 by the expansion difference.

SUMMARY OF THE INVENTION

In order to overcome the problems described above, preferred embodiments of the present invention provide a piezoelectric electroacoustic transducer that is capable of improving a yield ratio by preventing a short-circuit between an internal electrode and an external electrode due to the migration and also by preventing cracks from occurring in ceramic layers during polarization.

In accordance with a first preferred embodiment of the present invention, a piezoelectric electroacoustic transducer includes a plurality of piezoelectric ceramic layers deposited to define a deposited product, external electrodes disposed on the front and rear major surfaces of the deposited product, internal electrodes disposed between the adjacent piezoelectric ceramic layers, and dummy electrodes disposed between the adjacent piezoelectric ceramic layers and outside the internal electrodes via a gap, wherein the piezoelectric electroacoustic transducer flexually vibrates the deposited product by polarizing the entire piezoelectric ceramic layers in the same direction and in the thickness direction and also by applying an alternating signal between the external electrodes and the internal electrodes, wherein portions of the internal electrodes are exposed at at least one side surface of the piezoelectric ceramic layers, wherein the dummy electrodes are exposed at the other side surface of the piezoelectric ceramic layers, and wherein the external electrodes extend to the side surfaces other than the side surface at which the internal electrodes are exposed.

In accordance with a second preferred embodiment of the present invention, a method for manufacturing a piezoelectric electroacoustic transducer includes the steps of preparing a plurality of green sheets including piezoelectric ceramic layers, forming electric patterns to define an internal electrode and a dummy electrode on the surface of at least one of the green sheets, depositing the plurality of green sheets by interposing the internal electrode and the dummy electrode therebetween so as to obtain a deposited product, burning the deposited product so as to obtain a piezoelectric body, forming an electrode pattern to define a front external electrode on the front surface of the piezoelectric body, forming an electrode pattern to define a rear external electrode on the rear surface of the piezoelectric body, uniformly polarizing the piezoelectric body in the thickness direction by applying a voltage between the front and rear external electrodes, cutting the piezoelectric body into sizes of one element, and forming a side surface electrode disposed on a side surface of the cut element for electrically connecting between the front and rear external electrodes, and a side-surface electrode for drawing the internal electrode toward at least one of the front and rear surfaces of the element, wherein in the state that the piezoelectric body is cut into the elements, the internal electrode is formed between the piezoelectric ceramic layers while the dummy electrode is formed outside the internal electrode via a gap, wherein a portion of the internal electrode is exposed at at least one side surface of the piezoelectric ceramic layers while the dummy electrode is exposed on the other side surface of the piezoelectric ceramic layers, and wherein the front and rear external electrodes extend to a side surface other than the side surface of the piezoelectric ceramic layers, onto which the internal electrode is exposed.

Between the ceramic layers, the internal electrode and dummy electrode are provided, and both the electrodes are spaced via a gap so as not to be electrically connected together. A portion of the internal electrode is exposed at at least one side surface of the ceramic layers while the dummy electrode is exposed at the other side surface. The external electrodes extend to side surfaces other than the side surface at which the internal electrode is exposed. In other words, the internal electrodes do not extend to the side surfaces at which the external electrode is exposed. Therefore, on the side surfaces of the ceramic layers, the internal electrode cannot approach the external electrodes in the thickness direction so that a short-circuit due to the migration can be prevented. The dummy electrode comes close to the external electrodes in the thickness direction and has a possibility of the short-circuit occurring. However, since the dummy electrode is electrically insulated from the internal electrode; there is no possibility of the short-circuit occurring between the external electrodes and the internal electrode.

Even when the expansion difference of the ceramic layers between the internal-electrode-existent part and nonexistent part is produced during polarization, since the dummy electrode is provided in the internal-electrode-nonexistent part, the expansion difference of the ceramic layers is greatly reduced, enabling cracks in the ceramic layers to be prevented from occurring.

The internal electrode need not be exposed along the entire length of one side of the ceramic layers. The internal electrode may be exposed along a portion of one side or it may be exposed onto two or three sides by stretching over the sides. Similarly, the external electrode need not be exposed along the entire length of the side of the ceramic layers. The external electrode may be partially exposed along the side.

The ceramic layers are not limited to be two-layered structure described above and may be three-layered or other suitable multi-layered construction. In the case of the three-layer structure, the central layer has internal electrodes on both surfaces and does not contribute to the bending vibration because of equipotentiality.

Preferably, the gap between the internal electrode and the dummy electrode has a width of about 0.05 mm to about 0.40 mm.

When the gap width is increased, the expansion difference of the ceramic layers produced during polarization is increased, causing cracks to be produced. On the other hand, when the gap width is excessively reduced, the insulation distance between the internal electrode and the dummy electrode cannot be maintained. Then, when the gap width is about 0.05 mm to about 0.40 mm, a balance between the crack prevention and the insulation-distance securement can be obtained.

Preferably, the internal electrode has a substantially square shape that is exposed onto one side surface of the piezoelectric ceramic layers, wherein the dummy electrode has a substantially U-shaped configuration that surrounds three sides of the internal electrode via a gap, and wherein trimmed parts of the external electrodes are disposed at positions corresponding to the side surface of the piezoelectric ceramic layers at which the internal electrode is exposed.

In this case, the electrode configurations of the internal electrode and external electrodes are simplified, thereby facilitating manufacturing. Since the internal electrode is exposed at only one side, the migration is difficult to be produced, so that a diaphragm with stable characteristics can be obtained.

Preferably, a transducer further includes extension electrodes disposed at the positions at which the trimmed parts of the external electrodes are disposed, and side surface electrodes disposed on side surfaces of the piezoelectric ceramic layers, wherein the extension electrodes are connected to the internal electrodes via the side surface electrodes.

That is, the external electrode of the diaphragm is exposed outside, facilitating electrical connection to the outside. However, since the internal electrode is provided between the ceramic layers, outside connection cannot be performed as it is. Then, in order to extend the internal electrode toward at least the surface of the diaphragm, the extension electrode is provided in the portions at which the trimmed parts of the external electrodes are disposed, so that the extension electrode and the internal electrode are connected together via the end surface electrode disposed on the side surface of the ceramic layers, thereby facilitating the internal electrode to be connected outside.

Preferably, a transducer further includes island-shaped auxiliary electrodes disposed along the side surface of the piezoelectric ceramic layers between the both ends of the dummy electrodes and the internal electrodes, wherein the extension electrodes are disposed at two corners of the piezoelectric ceramic layers by stretching different two sides, and are disposed at positions which do not overlap with the dummy electrodes in the thickness direction.

In such a configuration, while cracks during polarization are reliably prevented, when a large number of deposited products are cut from a large motherboard, it is easy to respond to the difference between the cutting position and the electrode forming position. Also, the width of the extension electrode can be effectively increased.

According to the manufacturing method in accordance with the second preferred embodiment of the present invention, the diaphragm according to the first preferred embodiment can be efficiently manufactured. In such a method, after forming an electrode for polarization, it is etched to form an external electrode, the diaphragm made of a deposited piezoelectric body is liable to crack in the manufacturing process. The cracked or chipped failure due to handling is greatly increased during the etching process especially in a thin diaphragm having a thickness of about 50 $\mu$m or less. Whereas, in the manufacturing method according to the second preferred embodiment of the present invention, since the electrode for polarization is used as the external electrode as it is, the etching is not necessary and the diaphragm is scarcely loaded, improving the cracked or chipped failure rate.

Other features, elements, characteristics and advantages of the present invention will become more apparent from the following detailed description of preferred embodiments with reference to the attached drawings.

DETAILED DESCRIPTION OF PREFERRED EMBODIMENTS

Figure 1:
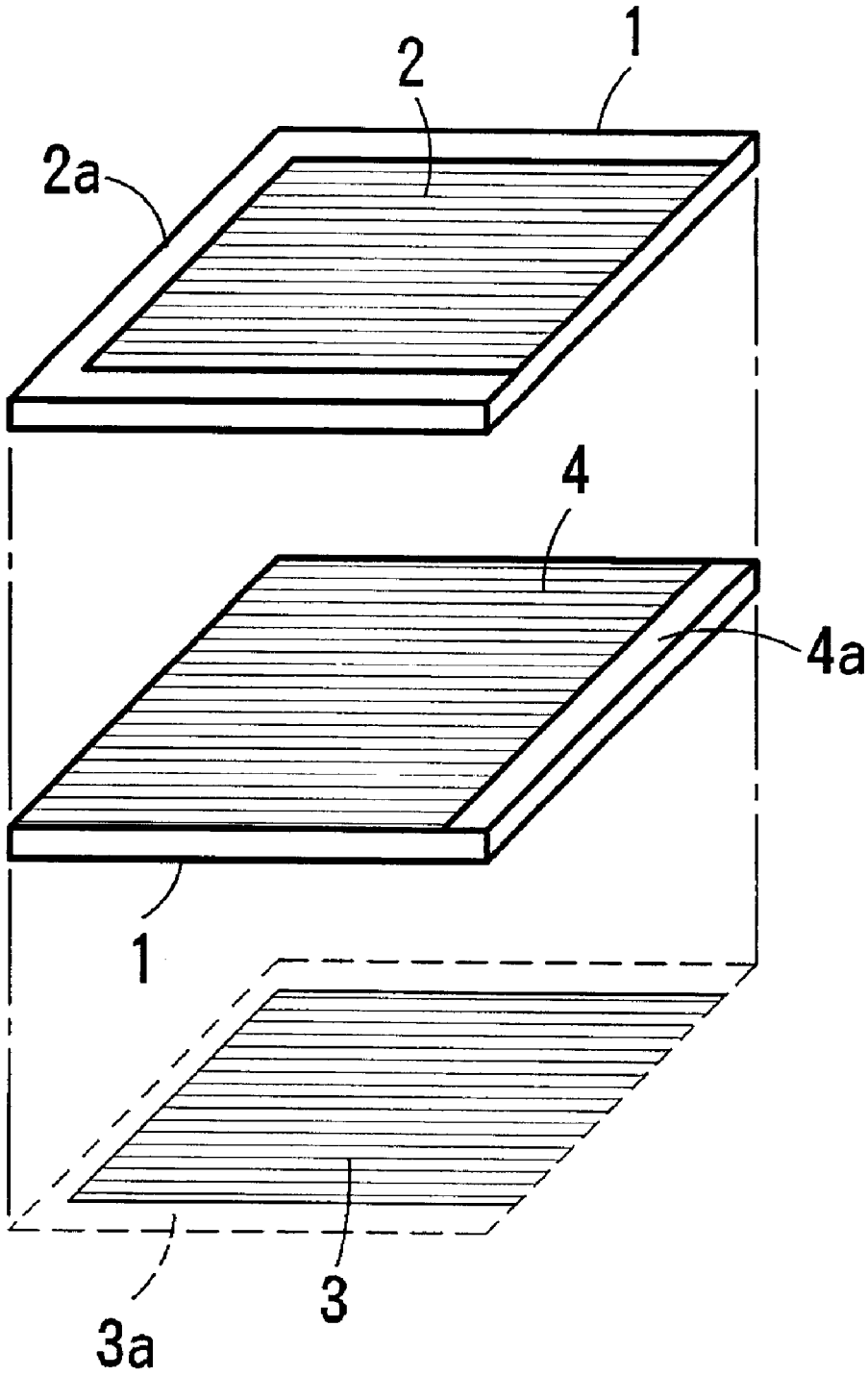
FIG. 1 is an assembly view of a piezoelectric diaphragm that forms the basis of preferred embodiments of the present invention.

FIGS. 2 to 9 show a surface-mounted piezoelectric electroacoustic transducer according to a first preferred embodiment of the present invention.

The piezoelectric electroacoustic transducer substantially includes a case 10, a lid plate 20, and a diaphragm 30 arranged to have a deposited structure.

The case 10, preferably made of an insulating material such as ceramic or a resin, preferably has a substantially rectangular box shape having a bottom wall 10*a* and four sidewalls 10*b* to 10*e*. When forming the case 10 of a resin, a heat-resistant resin may be preferable, such as an LCP (liquid crystal polymer), SPS (syndiotactic polystyrene), PPS (polyphenylene sulfide), and an epoxy resin. Inside the two opposing sidewalls 10*b* and 10*d*, step-like supporting members 10*f* and log are formed, and internal connections 11*a* and 12*a* of a pair of terminals 11 and 12 are exposed thereon. The terminals 11 and 12 are formed in the case 10 preferably by insert molding, in which external connections 11*b* and 12*b* protruding outside the case 10 are bent along external surfaces of the sidewalls lob and 10*d* toward the bottom wall 10*a* of the case 10. In the boundary between the other sidewall 10*c* and the bottom wall 10*a* of the case 10, a first sound-releasing hole 10*h* is formed.

A lid plate 20, preferably made of the same material as that of the case 10, is bonded to the upper opening of the case 10 with an adhesive (not shown). The lid plate 20 is provided with a second sound-releasing hole 21 formed thereon.

A diaphragm 30, as shown in FIGS. 5 to 9, is formed preferably by depositing two piezoelectric ceramic layers 31 and 32 and covering the front/rear surfaces with resin layers 40 and 41. These resin layers 40 and 41 are protecting layers for preventing cracks of the ceramic layers 31 and 32 due to dropping shock.

According to the present preferred embodiment, for the ceramic layers 31 and 32, a PZT ceramic plate having approximate dimensions of 10 mm×10 mm×20 $\mu$m is preferably used, and for the resin layers 40 and 41, a polyamidoimide resin with a thickness of about 5 mm to about 10 $\mu$m is used.

Figure 5:
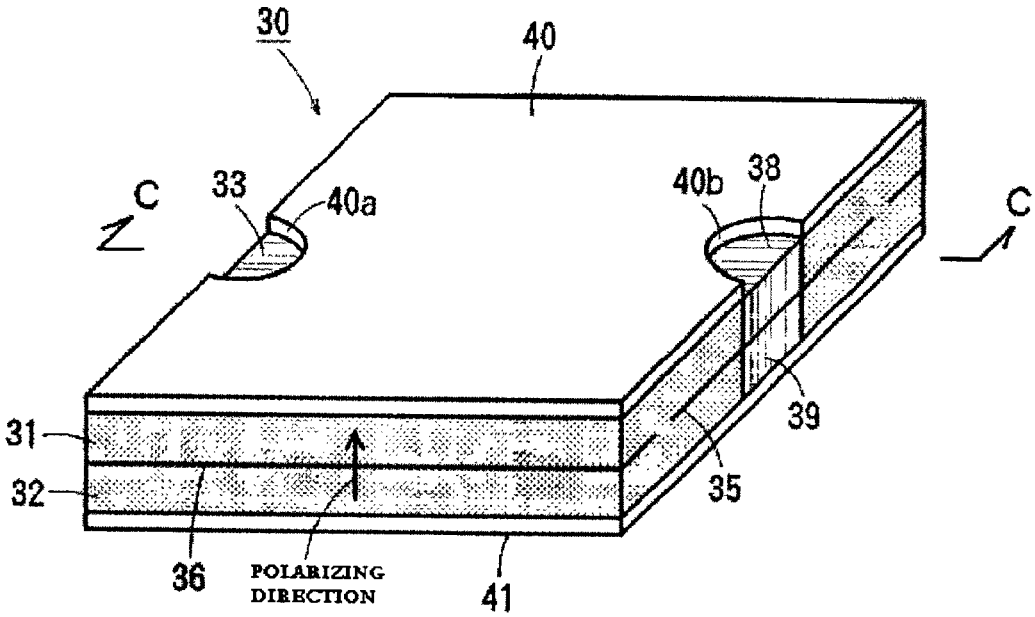
FIG. 5 is a perspective view of a piezoelectric diaphragm included in the piezoelectric electroacoustic transducer shown in FIG. 2.
Figure 6:
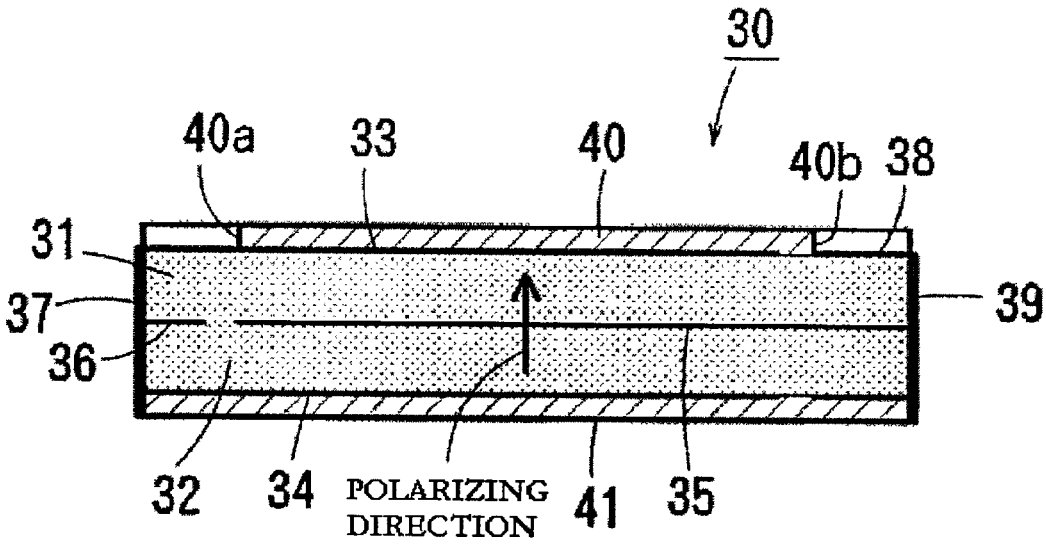
FIG. 6 is a sectional view along the line C—C of FIG. 5.

On the front/rear major surfaces of the deposited ceramic layers 31 and 32, external electrodes 33 and 34 are disposed, respectively, and between the ceramic layers 31 and 32, an internal electrode 35 and a dummy electrode 36 are disposed. The two ceramic layers 31 and 32, as shown by the heavy-line arrows in FIGS. 5 and 6, are polarized in the same thickness direction. On one side of the respective front/rear external electrodes 33 and 34, trimmed parts (or blank parts) 33*a* and 34*a* are formed, while the other sides thereof extend toward the edges of the ceramic layers 31 and 32. The external electrodes 33 and 34 extending to the edges are connected to a side surface electrode 37 (see FIG. 6) disposed on one side surface of the diaphragm 30. Accordingly, the front/rear external electrodes 33 and 34 are connected to each other. On the surface of the ceramic layer 31 and in the vicinity of the trimmed part 33*a* of the front external electrode 33, and an extension electrode 38, which is not connected to the external electrode 33, is disposed. The internal electrode 35 preferably has a substantially square shape and is exposed only at the side surfaces of the ceramic layers 31 and 32 on which the trimmed parts 33*a* and 34*a* of the external electrodes 33 and 34 are disposed, and the dummy electrode 36 preferably has a substantially U-shaped configuration arranged to surround the three sides of the internal electrode 35 via a gap G. The width of the gap G may preferably be about 0.05 mm to about 0.40 mm, and according to the present preferred embodiment, it is preferably about 0.15 mm. The dummy electrode 36 is exposed at the side surfaces of the three sides of the respective ceramic layers 31 and 32. On the side surface of the diaphragm 30 opposing the side surface having the side surface electrode 37, a side surface electrode 39 is provided for connecting the internal electrode 35 and the extension electrode 38 together.

In addition, by providing the side surface electrode 37, the external electrodes 33 and 34 are connected together and to the dummy electrode 36 as well. However, since the dummy electrode 36 is electrically insulated from the internal electrode 35, it does not interfere with electrical characteristics.

On the front resin layer 40 and on the two opposing sides of the diaphragm 30, a cut-out 40*a*, to which the external electrode 33 is exposed, and a cut-out 40*b*, to which the extension electrode 38 is exposed, are formed. According to the present preferred embodiment, the cut-outs 40*a* and 40*b* are formed only on the front resin layer 40. However, the cut-outs 40*a* and 40*b* may be formed on both the front/rear surfaces. In this case, the external electrode 34 may be exposed to the rear cut-out 40*a*, and the extension electrode 38 may be exposed to the front cut-out 40*b*.

The diaphragm 30 is accommodated within the case 10 so that two opposing sides thereof are placed on the supporting members 10*f* and 10*g*. The external electrode 33 exposed at the cut-out 40*a* of the resin layer 40 and the internal connection 11*a* of the terminal 11 are connected together preferably via a conductive adhesive 22, while the extension electrode 38 exposed at the cut-out 40*b* and the internal connection 12*a* of the terminal 12 are connected together preferably via a conductive adhesive 23. After curing the conductive adhesives 22 and 23, air leakage between the front/rear sides of the diaphragm 30 is prevented by applying and curing an elastic sealant 24 such as a silicone adhesive in the clearance between the periphery of the diaphragm 30 and the case 10 in an annular arrangement.

In addition, without being limited to the above-mentioned method, after applying and curing the elastic sealant 24 in advance, the conductive adhesives 22 and 23 may be applied and cured.

Also, the diaphragm 30 may be accommodated within the case 10 in a state that the conductive adhesives 22 and 23 are applied on both ends of the diaphragm 30.

In the electroacoustic transducer according to the present preferred embodiment, by applying a predetermined alternating voltage between the terminals 11 and 12, the alternating voltage is applied between the external electrodes 33 and 34 and the internal electrode 35 so as to flexually vibrate the diaphragm 30. As a piezoelectric ceramic layer, having the polarization direction that is identical to the electric field direction, contracts in the planar direction while a piezoelectric ceramic layer, having the polarization direction that is opposite to the electric field direction, expands in the planar direction, the entire layers bend in the thickness direction. Since the diaphragm 30 has the deposited structure of the piezoelectric ceramic layers without a metallic plate, and two vibrating regions sequentially arranged in the thickness direction vibrate individually in the direction opposite to each other, a larger displacement, i.e., larger sound pressure can be obtained in comparison with a unimorph-type diaphragm.

A sound produced by the diaphragm 30 is released outside via the second sound-releasing hole 21 formed in the lid plate 20.

On side surfaces of the two ceramic layers 31 and 32, the external electrodes 33 and 34 cannot approach the internal electrode 35, so that short-circuit between the external electrodes 33 and 34 and the internal electrode 35 due to the migration is reliably prevented.

FIGS. 10A to 10D show a method of manufacturing the diaphragm 30.

Figure 10A:
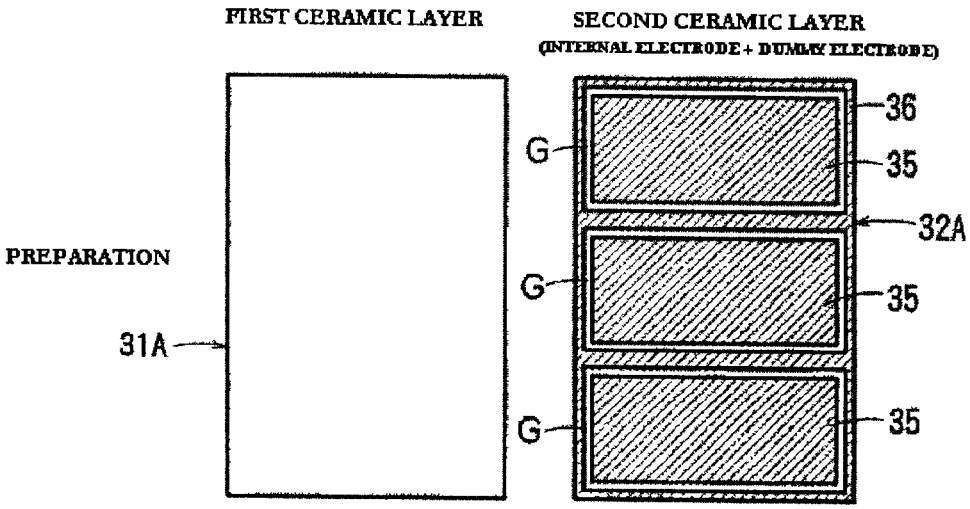
FIGS. 10A to 10D are process drawings showing a manufacturing method of the piezoelectric diaphragm shown in FIG. 7.

As shown in FIG. 10A, a first ceramic green sheet 31A without an electrode and a second ceramic green sheet 32A having the internal electrode 35 and the dummy electrode 36 disposed on the surface are prepared. For a ceramic green sheet, a PZT ceramic is used, for example. The internal electrode 35 and the dummy electrode 36 are formed preferably by applying conductive paste including Silver, Palladium, and an organic binder using a printing method.

Figure 10B:
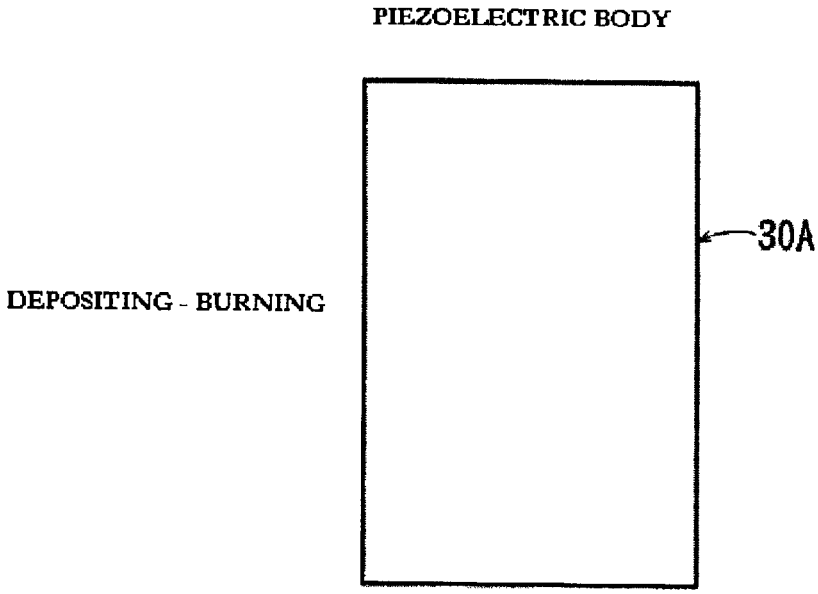

Next, as shown in FIG. 10B, the green sheets 31A and 32A are deposited and burned at approximately 1100° C. to obtain a piezoelectric body 30A with a thickness of approximately 40 $\mu$m.

Figure 10C:
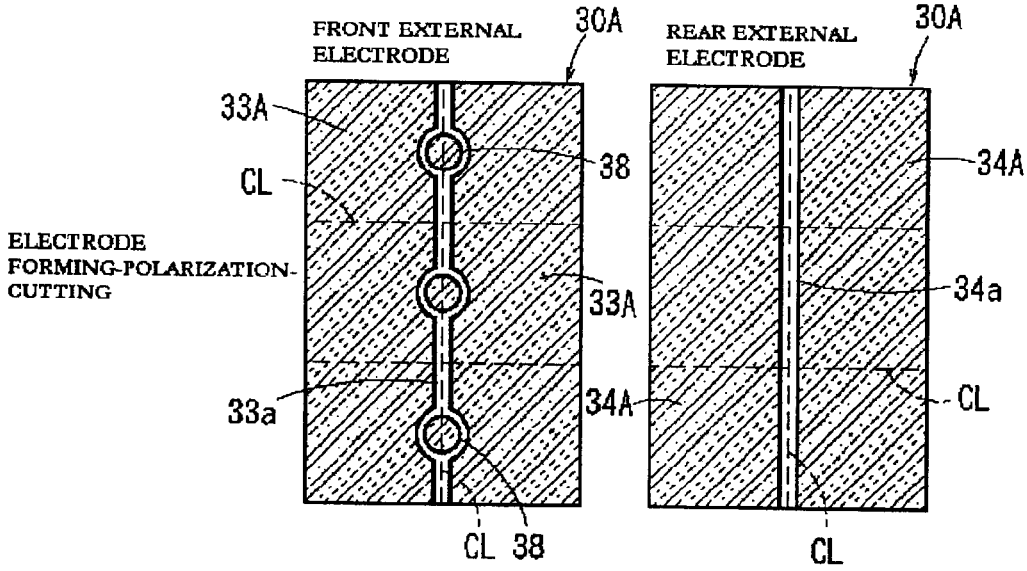

Then, as shown in FIG. 10C, a front external electrode 33A is formed on the surface of the piezoelectric body 30A of a motherboard state, while a rear external electrode 34A is formed on the rear surface of the piezoelectric body 30A. As for the forming method, a thin-film forming method such as sputtering using a metallic mask is preferably used.

At this time, on the front external electrode 33A, a blank part 33*a* to define a trimmed part and island-shaped electrodes to define the extension electrodes 38 are formed in advance. Also, on the rear external electrode 34A, a blank part 34*a* to be a trimmed part is formed.

After forming the external electrodes 33A and 34A, polarization is performed by applying a voltage between the front/rear external electrodes 33A and 34A. As the polarization condition, the electric field is preferably about 3.0 kV/mm and the holding time and holding temperature are kept constant at about 30 second and about 50° C., respectively. At this time, as a blank part does not substantially exist in the electrodes 35 and 36 disposed between the ceramic layers, there is scarcely expansion difference between the ceramic layers, thereby preventing the ceramic layer from cracking.

Figure 10D:
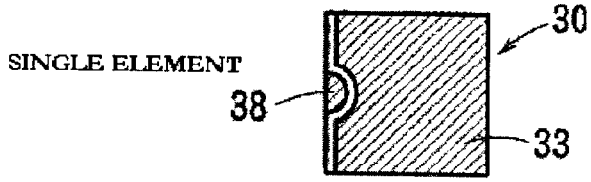

After polarization, the front/rear surfaces of the piezoelectric body 30A are coated with a resin and are cut along the dotted lines CL in FIG. 10C to obtain an element as shown in FIG. 10D. At this time, the cutting is performed so that the cutting lines CL run through the centers of the trimmed parts 33*a* and 34*a*. The resin layers 40 and 41 are formed on the front/rear surfaces of the cut element and the side surface electrodes 37 and 39 are formed, so that the diaphragm 30 is obtained.

For the configuration of the external electrode shown in FIG. 1, in order to form the trimmed part 2*a* in the periphery of the external electrode 2, after forming the electrode on the entire surface, a process in which a position corresponding to the trimmed part is coated with resist ink and the trimmed part 2*a* is formed by etching is needed. Whereas, as described above, when the external electrodes 33A and 34A are extending toward three sides, a complicated process such as the etching is not necessary because of the simplified electrode shape, so that a low-loaded patterning method can be selected. Thereby, the process can be simplified and the cracked or chipped failures due to handling can be reduced, and even in the thin-thickness piezoelectric body 30A, the yield rate is improved, thereby enabling mass production.

FIGS. 11A to 11D show another preferred embodiment of the external electrode and internal electrode of the diaphragm.

Figure 11A:
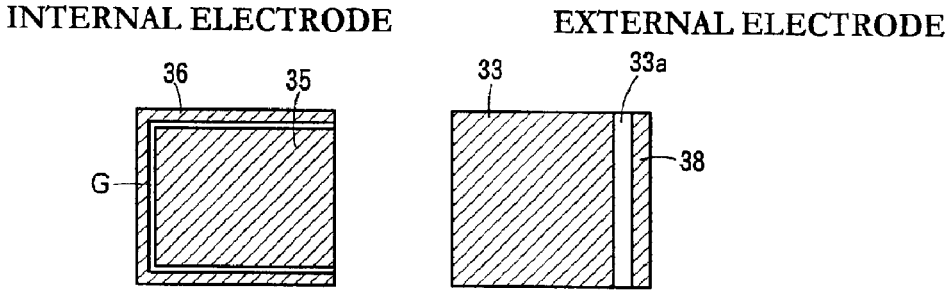
FIGS. 11A to 11D are other pattern drawings of an internal electrode and external electrode of the piezoelectric diaphragm.

As shown in FIG. 11A, the configurations of the internal electrode 35 and the dummy electrode 36 are the same as those of the first preferred embodiment. However, the difference between the second preferred embodiment and the first preferred embodiment is that one side of the external electrode 33 is provided with the strip-shaped extension electrode 38 formed via a blank part 33*a*. The extension electrode 38 is connected to the internal electrode 35 via the side surface electrode.

Figure 11B:
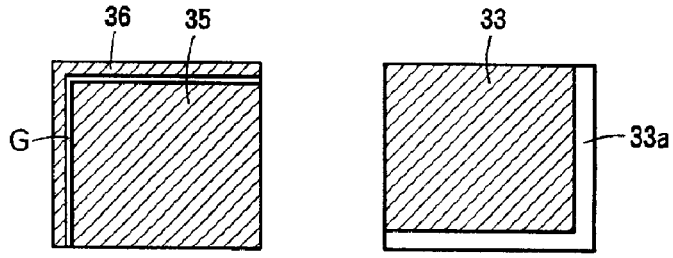

As shown in FIG. 11B, two adjacent sides of the internal electrode 35 are exposed on the side surfaces of the ceramic layer, and on the remaining two sides, the dummy electrode 36 is formed via the gap G. Similarly, on two sides of the external electrode 33, especially in parts corresponding to the sides having the internal electrode 35 exposed thereon, the trimmed part 33*a* is formed, while the remaining two sides are extending toward the peripheral edges of the ceramic layer.

Figure 11C:
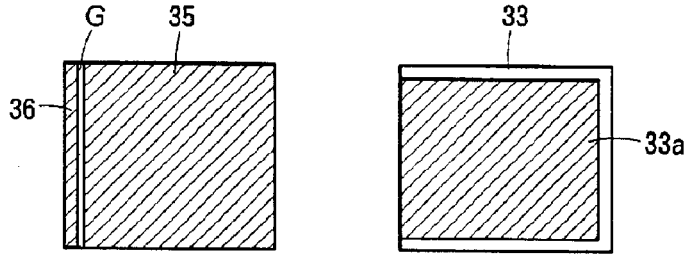

As shown in FIG. 11C, three sides of the internal electrode 35 are exposed on the side surfaces of the ceramic layer, and on the remaining one side, the dummy electrode 36 is formed via the gap G. Also, on three sides of the external electrode 33, that is, in the parts corresponding to the three sides having the internal electrode 35 exposed thereon, the trimmed part 33*a* is formed, while the remaining one side is extended toward the peripheral edge of the ceramic layer.

Figure 11D:
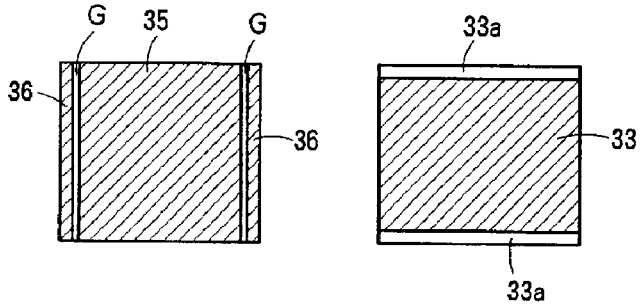

As shown in FIG. 11D, two opposing sides of the internal electrode 35 are exposed on the side surfaces of the ceramic layer, and on the remaining two sides, the dummy electrode 36 is formed via the gap G. On two sides of the external electrode 33, especially in parts corresponding to the sides having the internal electrode 35 exposed thereon, the trimmed part 33*a* is formed, while the remaining two sides are extended toward the peripheral edges of the ceramic layer.

Any of the electrode configurations shown in FIGS. 11A to 11D can prevent the migration and cracks during the polarization as well. In addition, the rear external electrode 34 may have the same configuration as that of the front external electrode 33.

Figure 12A:
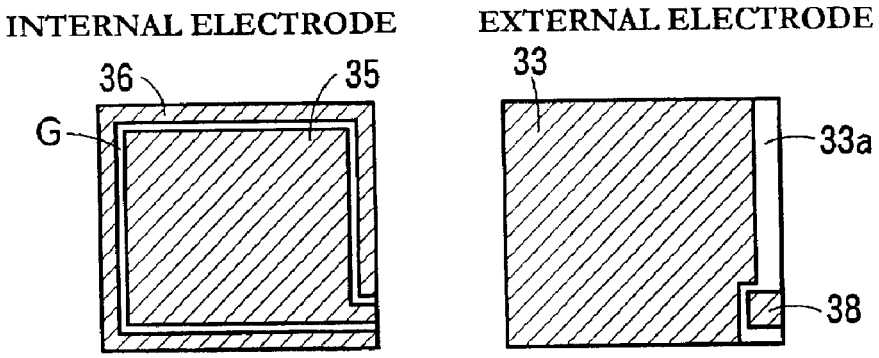
FIGS. 12A to 12D are still other pattern drawings of an internal electrode and external electrode of the piezoelectric diaphragm.

FIGS. 12A to 12D show still another preferred embodiment of the external electrode and internal electrode of the diaphragm. As shown in FIG. 12A, the internal electrode 35 is exposed only at a portion of one side of the ceramic layer, and the other portion is surrounded by the dummy electrode 36 via the gap G. On the other hand, on the side of the external electrode 33 having the internal electrode 35 exposed thereon, the trimmed part 33*a* is formed, and within the trimmed part 33*a* and at a position corresponding to the part having the internal electrode 35 exposed thereon, the island-shaped extension electrode 38 is formed. The extension electrode 38 is also connected to the internal electrode 35 via the side surface electrode.

Figure 12B:
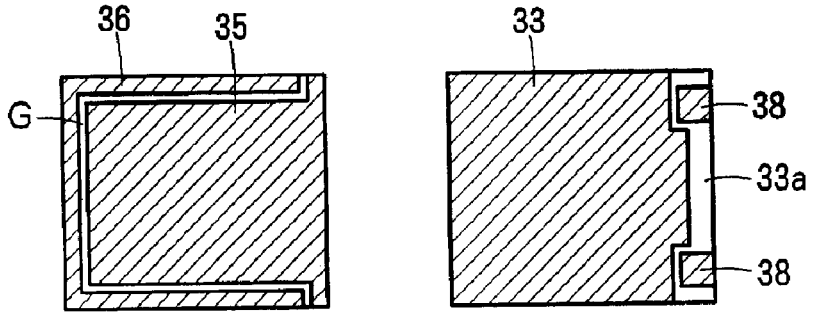

As shown in FIG. 12B, the internal electrode 35 is exposed at one side of the ceramic layer and also at portions of two sides that are adjacent to the one side, and the other portions are surrounded by the dummy electrode 36 via the gap G. On the other hand, on the side of the external electrode 33 having the internal electrode 35 exposed thereon, the trimmed part 33*a* is formed, and in vicinities of the both ends of the trimmed part 33*a* and at positions corresponding to the parts having the internal electrode 35 exposed thereon, the island-shaped extension electrodes 38 are formed. The extension electrodes 38 are connected to the internal electrode 35 via the side surface electrode. In this electrode pattern, the internal electrode 35, as well as the external electrode 33, is in the connected state in the step of the motherboard, so that the internal electrode 35 has an advantage of being simply formed.

Figure 12C:
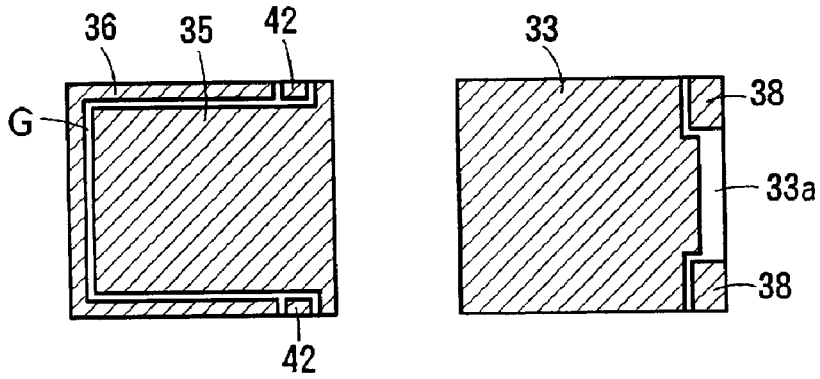

As shown in FIG. 12C, the internal electrode 35 is exposed at one side of the ceramic layer and also at portions of two sides adjacent to the one side, and the other portions are surrounded by the dummy electrode 36 via the gap G. Between the dummy electrode 36 and the internal electrode 35, two island-shaped auxiliary electrodes 42 are formed along the side surfaces of the ceramic layer by modifying the electrode configuration shown in FIG. 12C. On the side of the external electrode 33 having the internal electrode 35 exposed thereon, the trimmed part 33*a* is formed, and at both ends of the trimmed part 33*a*, the island-shaped extension electrodes 38, corresponding to the internal electrode 35 and the auxiliary electrodes 42, are formed.

According to the present preferred embodiment, by arranging the extension electrodes 38 at corners of the ceramic layer, the formation of the extension electrodes 38 is facilitated, enabling mass production. In forming the internal electrode 35 and the dummy electrode 36 in the configurations as shown in FIG. 12B, the dummy electrode 36 and the extension electrodes 38 are overlapped in the thickness direction, so that a short-circuit may develop therebetween because of the migration. Then, by forming the auxiliary electrodes 42 between the internal electrode 35 and the dummy electrode 36, a shot-circuit between the dummy electrode 36 and the extension electrodes 38 is prevented. Also, according to the present preferred embodiment, when a large number of diaphragms are cut from the motherboard, it is easy to respond to the difference between the cutting position and the electrode forming position, so that the width of the extension electrode 38 can be effectively increased.

Figure 12D:
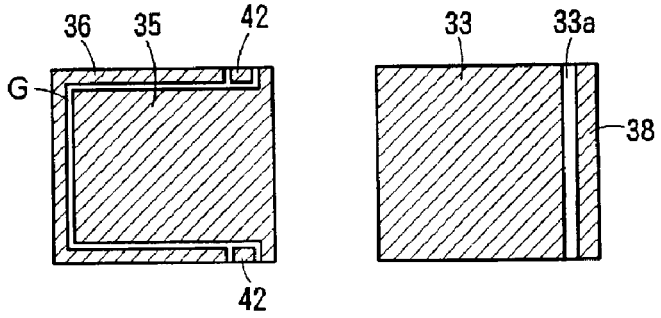

As shown in FIG. 12D, the configurations of the internal electrode 35, dummy electrode 36, and auxiliary electrode 42 are the same as those shown in FIG. 12C, while the configuration of the external electrode 33 is the same as that shown in FIG. 11A. That is, one side of the external electrode 33 is provided with the strip-shaped extension electrode 38 formed via the blank part 33*a*. In this case, the short-circuit between the dummy electrode 36 and the extension electrodes 38 is also prevented with the auxiliary electrode 42.

The present invention is not limited to preferred embodiments described above, and it can be modified within the spirit and scope of the present invention.

For example, the diaphragm 30 described above preferably has a two-layered piezoelectric ceramic structure. However, three or more layers may also be used.

Also, the diaphragm 30 may be substantially circular in addition to being substantially square.

Figure 2:
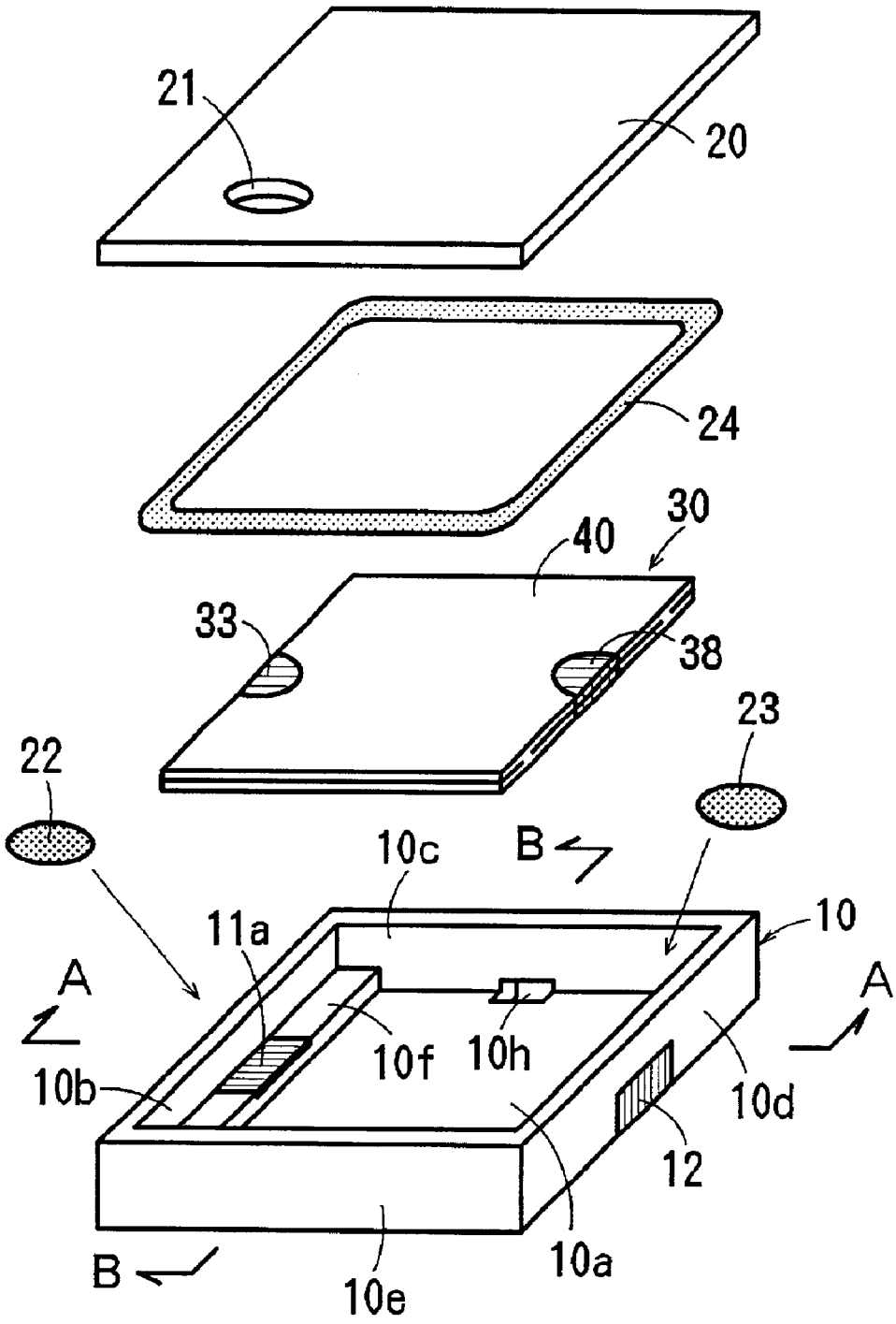
FIG. 2 is an assembly view of a piezoelectric electroacoustic transducer according to a first preferred embodiment of the present invention.
Figure 3:
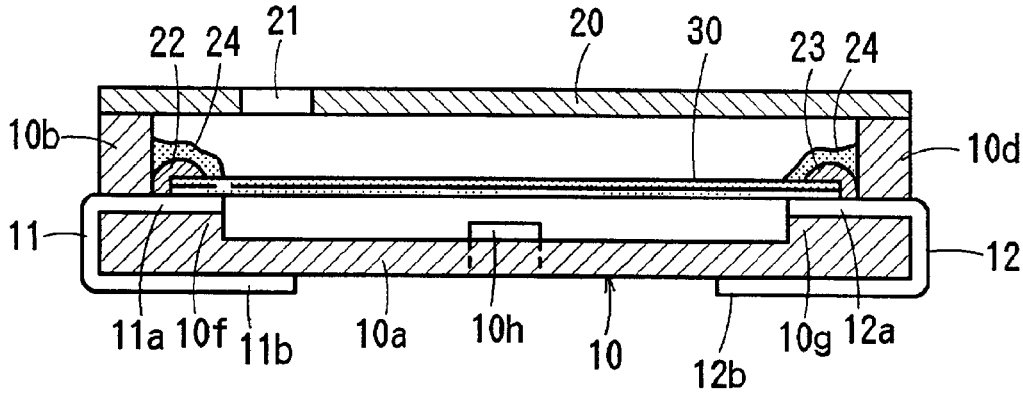
FIG. 3 is a sectional view along the line A—A of FIG. 2.
Figure 4:
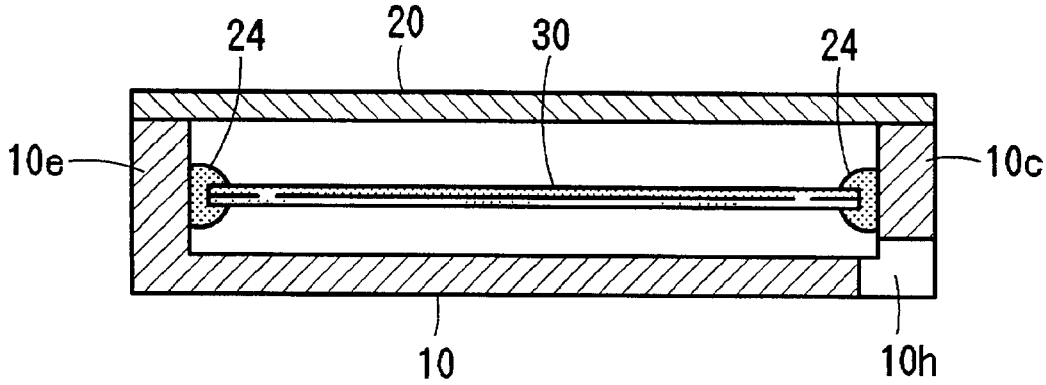
FIG. 4 is a sectional view along the line B—B of FIG. 2.
Figure 7:
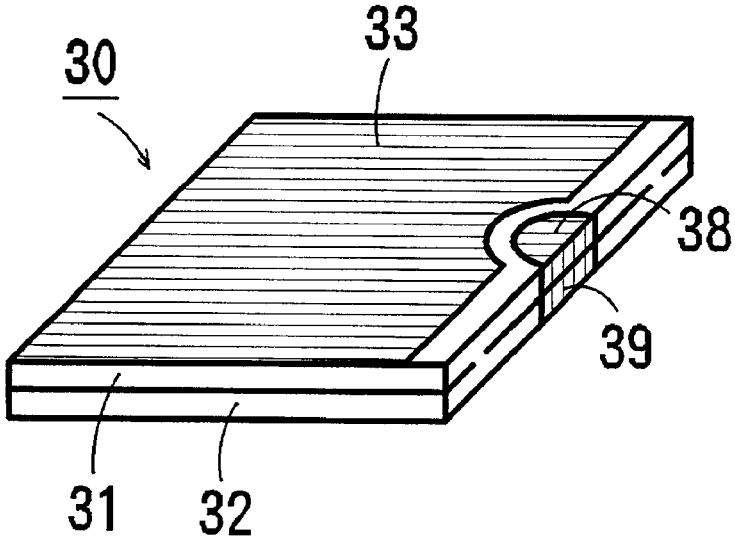
FIG. 7 is a perspective view of the piezoelectric diaphragm shown in FIG. 5 in a state that a resin layer is omitted.
Figure 8:
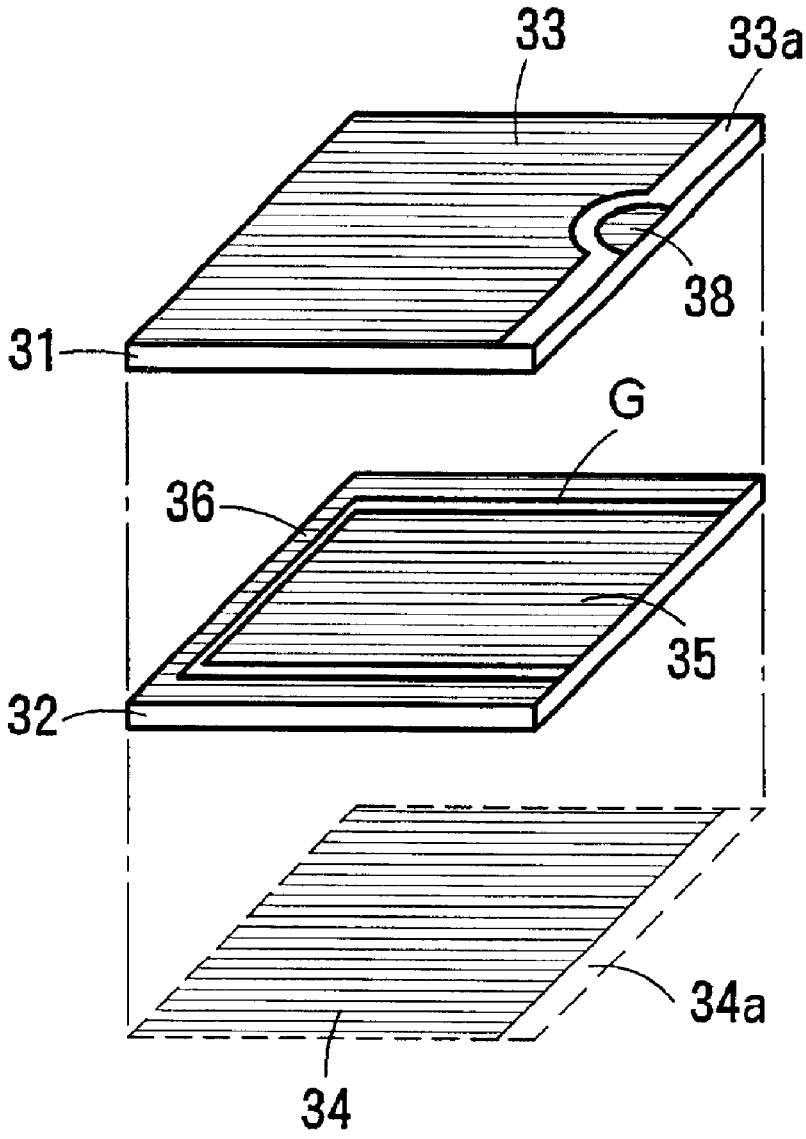
FIG. 8 is an assembly view of the piezoelectric diaphragm shown in FIG. 7.
Figure 9:
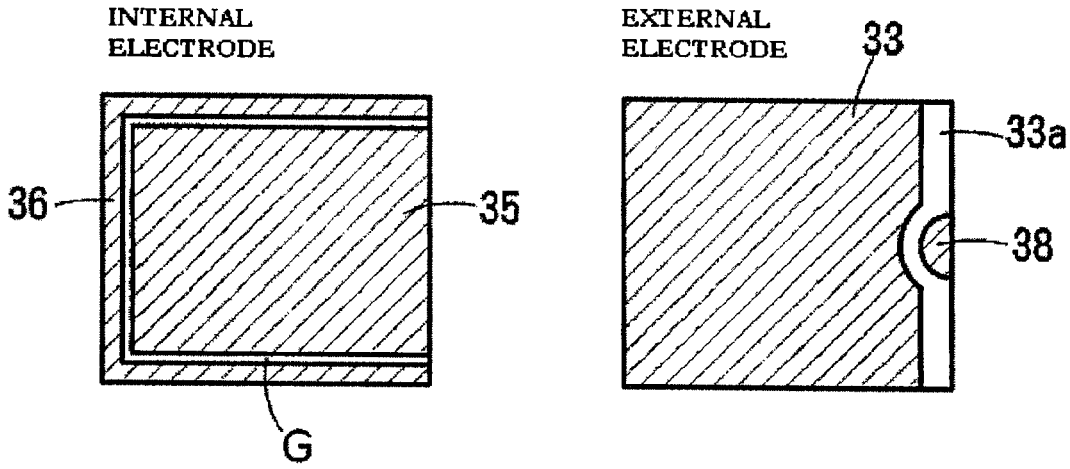
FIG. 9 includes drawings of an internal electrode and external electrode of the piezoelectric diaphragm shown in FIG. 7.

The case according to the present invention is not limited to the structure including a case having terminals as shown in FIGS. 2 to 4 and the lid plate to be bonded on the top surface. For example, as shown in FIGS. 7 and 8 of the above-mentioned Japanese Unexamined Patent Application Publication No. 2001-95094, the case may be formed of a cap having a supporting member for fixing the diaphragm and a substrate having an electrode for external connection.

As for a terminal to be fixed to the case, it is not limited to the inserted terminal according to preferred embodiments. Alternatively, the terminal may be a thin film or thin-film electrode extending from the top surface of the case supporting member to the outside.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A piezoelectric electroacoustic transducer comprising:

a plurality of piezoelectric ceramic layers deposited so as to define a deposited product having top and bottom major surfaces;

external electrodes disposed on the top and bottom major surfaces of the deposited product;

internal electrodes disposed between adjacent ones of the plurality of piezoelectric ceramic layers; and dummy electrodes disposed between adjacent ones of the plurality of piezoelectric ceramic layers and outside the internal electrodes via a gap; wherein all of the plurality of piezoelectric ceramic layers are polarized in the same direction of thickness of the deposited product and the piezoelectric electroacoustic transducer flexurally vibrates in response to application of an alternating signal applied between the external electrodes and the internal electrodes, portions of the internal electrodes are exposed at at least a first side surface of the piezoelectric ceramic layers, the dummy electrodes are exposed at a second side surface of the piezoelectric ceramic layers, and the external electrodes extend only to side surfaces other than the first side surface at which the internal electrodes are exposed;

trimmed portions of the external electrodes are disposed at positions corresponding to the side surface of the piezoelectric ceramic layers at which the internal electrodes are exposed;

extension electrodes are disposed at the positions in which the trimmed portions of the external electrodes are disposed, and side surface electrodes are disposed on side surfaces of the piezoelectric ceramic layers; and the extension electrodes are connected to the internal electrodes via the side surface electrodes.

2. A piezoelectric electroacoustic transducer according to claim 1, wherein the gap between the internal electrodes and the dummy electrodes has a width of about 0.05 mm to about 0.40 mm.

3. A piezoelectric electroacoustic transducer according to claim 1, wherein the internal electrodes have a substantially square shape and are exposed at one side surface of the piezoelectric ceramic layers.

4. A piezoelectric electroacoustic transducer according to claim 1, wherein the dummy electrodes have a substantially U-shaped configuration arranged to surround three sides of the internal electrodes via a gap.

5. A piezoelectric electroacoustic transducer according to claim 1, further comprising island-shaped auxiliary electrodes disposed along the side surface of the piezoelectric ceramic layers between the both ends of the dummy electrodes and the internal electrodes, wherein the extension electrodes are disposed at two corners of the piezoelectric ceramic layers by stretching different two sides, and are disposed at positions which are not overlapped with the dummy electrodes in the thickness direction.

6. A piezoelectric electroacoustic transducer according to claim 1, further comprising a case and a lid plate, wherein the deposited product is disposed in the case and covered by the lid.

7. A piezoelectric electroacoustic transducer according to claim 6, wherein the case includes a sound-releasing hole formed thereon.

8. A piezoelectric electroacoustic transducer according to claim 6, wherein the lid plate includes a sound-releasing hole formed thereon.

9. A piezoelectric electroacoustic transducer according to claim 1, wherein resin is provided on each of the plurality of piezoelectric ceramic layers.

10. A piezoelectric electroacoustic transducer according to claim 1, wherein the external electrodes are connected to each other and are connected to the dummy electrodes.

11. A piezoelectric electroacoustic transducer according to claim 1, further comprising a case, wherein the deposited product is a diaphragm which is mounted inside of the case.

12. A piezoelectric electroacoustic transducer according to claim 1, wherein the external electrodes are spaced from the internal electrodes.

* * * * *